US005952797A

United States Patent [19]

Rössler

[11] Patent Number: 5,952,797

[45] **Date of Patent: *Sep. 14, 1999**

[54] MODEL VEHICLE, PARTICULARLY MODEL RAILWAY VEHICLE

[76] Inventor: Elfriede Rössler, Jakob-Auer-Strasse 8, A-5033 Salzburg, Austria

[ * ] Notice: This patent issued on a continued prosecution application filed under 37 CFR 1.53(d), and is subject to the twenty year patent term provisions of 35 U.S.C. 154(a)(2).

[21] Appl. No.: 08/865,296

[22] Filed: May 29, 1997

[30] Foreign Application Priority Data

Jun. 3, 1996 [AT] Austria ..... 956/96

[51] Int. Cl.[6] ..... B23Q 5/10

[52] U.S. Cl. ..... 318/39; 246/4; 104/DIG. 1

[58] Field of Search ..... 318/139, 34, 39; 246/3, 4, 5, 6, 7, 167 R, 187 R, 187 A, 182 R, 187 B, 191, 192 R, 193, 194, 196; 180/167; 446/433, 442, 454–467; 104/296, 295, 297, 300, 301, DIG. 1

[56] References Cited

U.S. PATENT DOCUMENTS

| | | | |
|---|---|---|---|
| 4,307,302 | 12/1981 | Russell | 307/40 |
| 4,335,381 | 6/1982 | Palmer | 246/187 |
| 4,341,982 | 7/1982 | Lahti et al. | 318/51 |
| 4,572,996 | 2/1986 | Hanschke et al. | 318/599 |
| 5,073,750 | 12/1991 | Coron | 340/825.72 |
| 5,267,318 | 11/1993 | Severson et al. | 395/2.79 |
| 5,321,344 | 6/1994 | Ott et al. | 318/280 |
| 5,749,547 | 5/1998 | Young et al. | 246/4 |

*Primary Examiner*—Jonathan Salata
*Attorney, Agent, or Firm*—Alston & Bird LLP

[57] ABSTRACT

A model vehicle such as a model railway vehicle includes a control and evaluation device located in the model vehicle, and a plurality of drive devices such as electric motors for moving the vehicle and for operating other movable components on the vehicle. A definable address is associated with the model vehicle, for example by being stored in a memory device connected to the control and evaluation device. The control and evaluation device includes or is connected to a switching network that is operable to selectably connect one of the drive devices to a regulating device in response to control signals from a central control unit. The regulating device is connected to a power supply and is operable to regulate the power supplied to the selected drive device in response to control signals from the central control unit. The control unit sends an address as part of its control signals, and the vehicle responds to the control signals if it has an address matching that sent by the control unit. Thus, a plurality of drive devices on a single vehicle can be selectively operated based on a single address unique to that vehicle.

27 Claims, 5 Drawing Sheets

CENTRAL CONTROL UNIT
VOLTAGE CONVERTOR
ADDRESS/CHARACTERISTIC
DEMO./FILTER/
M1
M2
M3
1
2
3
5
6
7
8
9
15
20
21
22
32
33
34
35
36
37
39
40
41
42
43
68
69
70
71
81
82
89
90
95
96
100
101
102
103
104
105
106
107
108
109
110
111
112
113
114
115
116
117
118

MODEL VEHICLE, PARTICULARLY MODEL RAILWAY VEHICLE

BACKGROUND OF THE INVENTION

1. Field of the Invention

The invention relates to a model vehicle, particularly a model railway vehicle, comprising means of deriving a supply voltage from an electrical supply network, and deriving control signals from a central control unit; at least one control and evaluation device, located in the model vehicle; at least one regulating device, which is associated with the control and evaluation device; at least one definable address, which is associated with the model vehicle or with the control and evaluation device; a plurality of electrical consumers, located in the model vehicle.

2. The Prior Art

Model vehicles for model railway systems are already known which are mounted on a rail network and, controlled by a control device, can be moved via their travelling gear on said rail network. These model vehicles, designed as locomotives or motor wagons, have a clearly allocated address, so that a deliberate selection may be made from a plurality of model vehicles provided with travelling gear, and to enable the selected model vehicle to be controlled in its travelling movements. These model vehicles, designed as motor wagons, in addition if necessary also have additional functions, which may be merely switched on or off via the control device, such as a headlight, steam generator, signal horn, etc. A disadvantage in this case is that, with a model having a plurality of different travelling functions, these can only be carried out manually on the respective model vehicle itself, apart the travelling gear.

SUMMARY OF THE INVENTION

The object of the present invention is to provide a model vehicle which has a plurality of controllable or regulable movement functions and all the functions of this model vehicle can be regulated individually and in a remote manner without reconstruction of the existing control system.

This object of the invention is achieved by the arrangement of a plurality of drive devices and a switching network, associated with or following the control and evaluation device, said switching network serving for selectably connecting one of the devices to at least one regulating device. The advantage in this is that even model vehicles with a plurality of operating functions, particularly special model vehicles, which have, true to reality, a plurality of movement functions, can execute in a remotely-controlled manner all the movement functions and also other operational functions via the individually controllable drive devices. As a result of the fully functional remotely controlled model vehicle, the entertainment value in using such a model vehicle increases sharply as the model, corresponding to the real pattern, can execute a large number of movement functions. It is further advantageous that the control device of the model railway system already present can be retained unaltered, as only the control and evaluation device in the corresponding model vehicle need be expanded or adapted.

It is also advantageous if the regulating device for altering the supply duration, and if necessary the supply voltage, is used for the electrical consumers or the drive devices.

Furthermore, however, the electrical consumers or drive devices may be applied via the switching network directly to the power supply line.

A further advantage is found in a design in that the switching network with function keys is electrically coupled on the central control unit or on an operating and/or display apparatus incorporated before it, in that in this way, with the previously used operating and/or display apparatus, a selection from among the various operational functions can be made, so that a universal operating and/or display apparatus results, and thus the costs can be kept relatively low.

Of advantage also is a design in that output signals of a regulating button of the operating and/or display apparatus or of the central control unit are in contact with the addressed control and evaluation device or with the regulating device or with the regulating device preceding the respective drive device, as in this way the speed of the selected drive device of the addressed model vehicle may be sensitively regulated.

A further advantage however is found if the regulating button is designed to emit control signals for speeds and/or directions of rotation, selectable thereby, of the drive devices, as both the speed and the direction of rotation of the drive devices may be altered clearly, rapidly and conveniently with a regulating button as an operating element.

A further advantageous design is characterised in that the control signals of the regulating button are connected to a control device of the control and evaluation device, or with a switch-over device following the latter, or with a plurality of switch-over devices respectively associated with the drive devices, and with the regulating device or regulating devices respectively associated with the drive devices, as in this way both the direction of rotation and also the speed of each drive device can be altered by means of one single regulating button, and thus a compact and well-arranged operating and/or display apparatus is made possible.

Of further advantage is a variant in which the switch-over device is formed for reversal of the direction of rotation, and the regulating device for alteration in speed of the drive devices by bridge circuits with pulsed switch members, as both the speed and the direction of rotation of an electrical drive device may be altered or adjusted with a commercially available, preferably integrated bridge circuit, so that the outlay on components for the control and evaluation device is relatively low, and thus can take into account the restricted space available in a model vehicle.

Also of advantage is the design in that the bridge circuits are constructed as a full bridge or as a half bridge, as in this way drive devices with variable operational voltages can be used, or drive devices may be used whose operational voltage is lower than the mains supply voltage available.

Of further advantage is a variant in that a decoding unit is arranged for optional connection of one or more of the drive devices to the supply voltage via the bridge circuits, as in this way the control commands issued via the operating and/or display apparatus can be clearly allocated to the corresponding drive device.

By means of the further development, a specific selection may be made from a plurality of model vehicles for triggering via the operating and/or display apparatus, if the memory device is associated with the decoding unit.

By means of the advantageous design in that the decoding unit is electrically conductively connected to each control and evaluation device by a data line with the rail system, and evaluates the received control signals, the supply voltage applied to the rail network and the control signals are available at any time to every control and evaluation device of the model vehicles.

It is also advantageous that the model vehicle may also be used on a control system with alternating current, as its alternating-voltage signals for the control information, or the alternating voltage for the drive power, above all cannot have a disadvantageous effect on the direction of rotation of the drive devices, if a rectifier, especially a bridge rectifier of the control and evaluation device is electrically conductively connected at the input side by lines to the electrical supply network, and is electrically conductively connected at the output side via supply lines to the bridge circuits.

With the design if the electrical supply network is formed by a rail system, electrical power and control signals may be passed to the model vehicle wherever it is positioned.

Of further advantage is a further development in which a demodulator for separating the supply voltage and the control signal is disposed between the electrical supply network and the regulating device, as in this way, despite the common transmission of the supply voltage and of the control signal, a separate supply is made possible to the respective end consumers or receiving devices.

A development is also possible in which, in an advantageous way, the control signals filtered out of the supply voltage can have no effect on the operational behaviour of the electrical drive devices, if the the control and evaluation device comprises the demodulator or a filter circuit, and the latter is connected at the output side to the control device and to the regulating device or the switch-over device.

Also of advantage is the design when the control system is once again initiated, no time-consuming reconfiguration need be carried out, yet re-addressing of the model vehicles can be carried out as required at any time, if the memory device of the control and evaluation device is formed by non-volatile memory, especially by DIP switch or by EEPROM memory, and is connected to the control device or to the decoding unit.

A further advantageous design is the control and evaluation device has an additional output, especially for triggering luminous means or an electromagnet, as in this way also switch-on or switch-off functions of a model vehicle may be remotely controlled with the same control and evaluation device.

A further development is also advantageous, if the control and evaluation device comprises a display means for indicating the drive device selected via the function keys, or the additional output selected, the display means being if necessary formed by miniature incandescent lamps and/or light-emitting diodes as in this way it may be easily recognised visually which function of the model vehicle has been selected for triggering, so that erroneous operations of the model vehicle can be excluded.

An embodiment is advantageous if the function keys for selecting the drive devices or the additional output, are formed by a multiple stage rotary or multiple stage sliding switch, particularly when there are more than four functions of a model vehicle to be controlled, as in this way the desired function may be selected rapidly, clearly and with a low probability of error.

An advantageous design enables a selection from among a plurality of preferably differently-designed model vehicles mounted on the rail network, so that a plurality of model vehicles may be controlled successively with only one operating and/or display apparatus, if a selector switch on the operating and/or display apparatus or on the central control unit is electrically coupled to the control device or to the decoding unit.

The advantageous design in which the control and evaluation device is designed for use on a control system with a direct current system or an alternating current system enables a homogenous control and evaluation device both for control systems with alternating current and for control systems with direct current, so that, due to the mass production of large numbers of identical types, the manufacturing costs for such a control and evaluation device can be kept low.

Finally, the present invention also comprises a model vehicle, such as a model railway crane, comprising a running gear frame; a superstructure; a crane located on the superstructure, and with a crane cable and with a crane hook secured to one end of the crane cable; a cable drum located on the superstructure and connected with another end of the crane cable; an electric motor in a driving connection with the cable drum; a bearing arrangement between the running gear frame and the superstructure; a drive device with an electric motor which is associated with the bearing arrangement and is in driving connection therewith; the superstructure is pivotable relative to the running gear frame by means of the bearing arrangement and of the drive device. Advantageous in this respect is the fact that the numerous functions of this model vehicle may be executed electrically, so that remote control of these functions is possible.

A further development is of advantage if the crane jib is mounted on an axis disposed on the superstructure and is in driving connection with the drive device especially with the electric motor via a cable drum and a jib cable as, by using the principles of leverage, the lifting power of the model vehicle may be altered in a simple manner.

By means of the advantageous design the individual movement functions of the model vehicle may be driven electrically, if the electric motor of the drive device is electrically conductively connected via lines, and the electric motor of the drive device via lines, and the electric motor of the drive device via lines with the control and evaluation device.

The advantageous design enables a favourable layout of the output lines for the control and evaluation device, if the control and evaluation device is located in the superstructure.

A further embodiment enables a favourable layout of the supply lines for the supply voltage and for the control signals of the model vehicle, if the control and evaluation device is located in the running gear frame.

Also of advantage is a design in which the electric motor of the drive device for rotary drive of the superstructure is secured in the running gear frame, as the design of the frame of the running gear of the model vehicle, true to reality, enables the electric motor to be invisibly mounted in a simple way, with simultaneous optimum utilisation of the space conditions in the model vehicle.

If the electric motor of the drive device for rotary drive of the superstructure is secured in the superstructure, in an advantageous way the conductors for the electric motor are prevented from winding about the axis of rotation of the bearing arrangement for the rotary drive of the model vehicle.

In addition to a cost-effective and long-lasting construction of the control and evaluation device, an acoustic indication of the switch-over procedure when changing the operational function of the model vehicle is achieved in an advantageous way, if the switching network between the individual drive devices and the regulating device or the switch-over device is formed by relays.

By means of the advantageous design in which the relays are formed as bistable relays with switch-over contact the keys located on the operation and/or display apparatus may be compared in their effect by a switch, so that the operational function of the model vehicle selected via these keys remains stored in a simple manner after the keys have been released.

Further advantageous designs enables a cost-effective and operationally-reliable switching network can be provided in a simple way for four selectable operational functions of a model vehicle; the functions of the model vehicle which may merely be switched on or off can be controlled via the regulating button of the operating and/or display apparatus; mechanical or electrical overloads on the drive devices and resultant mechanical and electrical damage to the model vehicle may be prevented in a simple way; a simple and cost-effective construction of the overload clutch; and finally that the torques produced by the drive devices, or the excessively high torques acting from the exterior on the drive devices, can cause no damage to the model vehicle, and furthermore a simple, cost-effective and long-lasting construction of the slip clutch.

BRIEF DESCRIPTION OF THE DRAWINGS

The invention will be described in more detail in the following with reference to the embodiments given by way of example and shown in the drawings.

Shown are.

DETAILED DESCRIPTION OF PREFERRED EMBODIMENTS

Figure 1:
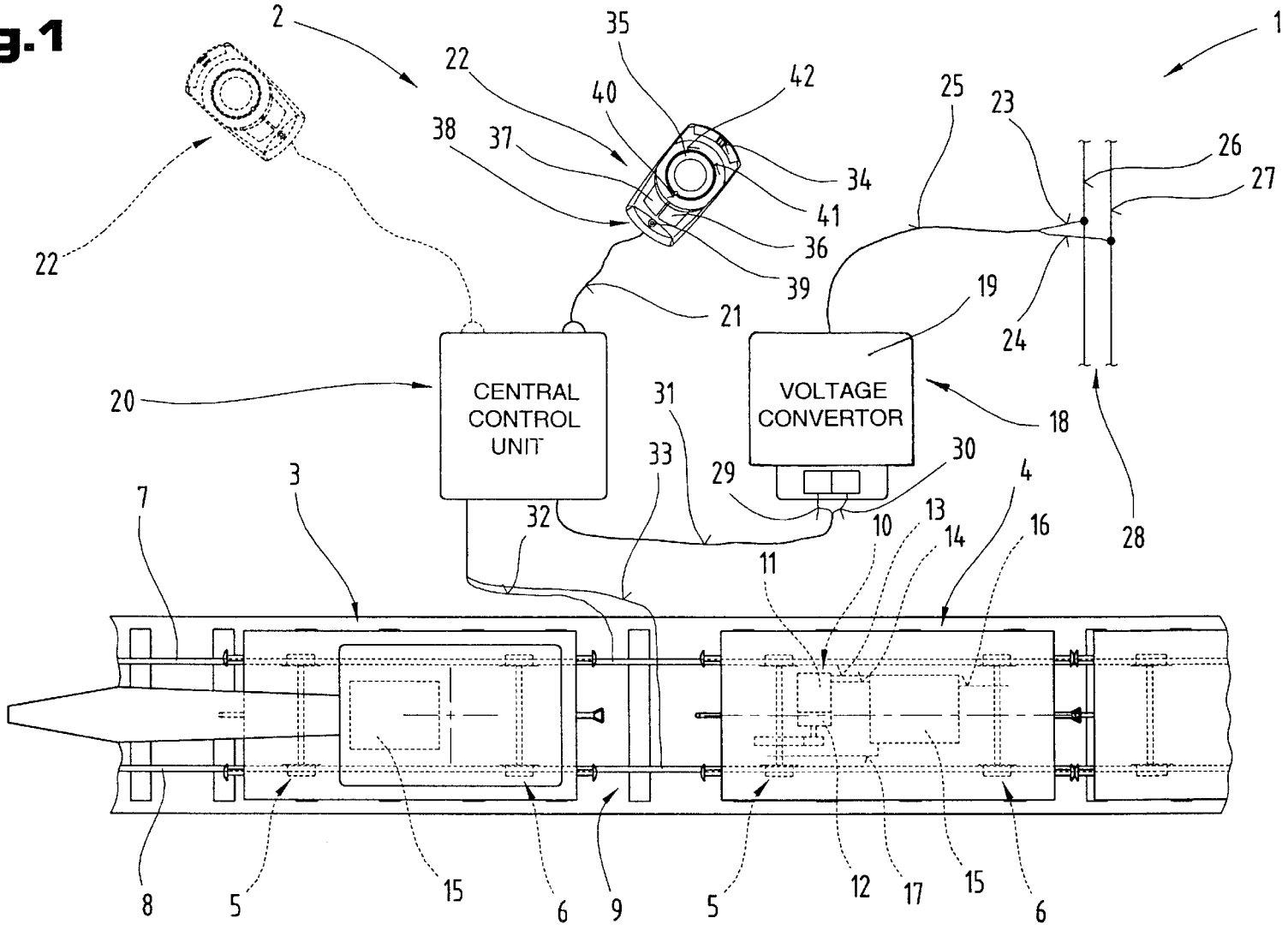
FIG. 1 a simplified schematic view of a portion of a model railway system.

FIG. 1 shows a simplified schematic view of a portion of a model railway system 1 with an electrical control system 2 for one or a plurality of model vehicles 3, 4. Each of the model vehicles 3, 4 or also further model vehicles not shown, or also only a single model vehicle, is supported by respective wheel and axle arrangements 5, 6 on rails 7, 8 of a rail system 9.

At least one model vehicle 3, 4 of the model railway system 1 has a drive device 10, in particular an electric motor 11. The drive device 10 is preferably connected in the direction of rotation with an interposed transmission unit 12 or torque converter, with at least one axle of the wheel and axle arrangement 5, 6. The electric motor 11 is electrically conductively connected via lines 13, 14 to a control and evaluation device 15. The control and evaluation device 15 is electrically conductively connected via a line 16 and preferably a sliding contact with at least one axle or a wheel of the wheel and axle arrangement 6 and in further sequence with one of the rails 7, 8, for example the rail 7. The control and evaluation device 16 is electrically conductively connected by a further line 17, preferably via a sliding contact, to at least one axle and/or one wheel of the wheel and axle arrangement 5, and in further sequence with the other rail, accordingly rail 8.

It is likewise possible, instead of the sliding contacts described, to transmit electrical power from the wheel and axle arrangement 5, 6 to the control and evaluation device 15 in a contactless, particularly inductive manner.

The electrical control system 2 comprises a voltage converter 18, particularly a transformer 19, a central control unit 20 and at least one operating and display apparatus 22 connected by a connector cable 21 to the central control unit 20. The voltage converter 18 is connected by lines 23, 24 of a cable 25 to a phase-conductor 26 and a neutral conductor 27 of a voltage supply network 28. On the output or secondary side, the voltage converter 18 or transformer 19 is electrically conductively connected by lines 29, 30 of a cable 31 to the central control unit 20, thus providing the central control unit 20 with electrical power.

It is likewise possible to integrate the voltage converter 18 or transformer 19 into the central control unit 20, and to connect the central control unit 20 directly to the voltage supply network 28.

In turn, the central control unit is in electrically conductive connection with the rails 7 of the rail network 9 by means of a line 32, and with the rail 8 of the rail network 9 via a line 33.

The electrical voltage of the voltage supply network 28 is converted in the voltage converter 18, particularly stepped down, and passed over cable 31 to the central control unit 20, so that the latter is supplied with power.

The connector cable 21 further supplies the operating and/or display apparatus 22 of the central control unit 20, with electrical power, among other things.

It is of course possible to connect a plurality of operating and/or display devices 22 for a plurality of users of the model railway system 1 to the central control unit 20.

The operating and/or display apparatus 22 has a selector switch 34, preferably in the manner of a multi-stage switch, a regulating button 35, at least one function key, preferable two keys 36, 37 and if necessary a display device 38, preferably a light-emitting diode 39.

By means of the seletor switch 34 on the operating and/or display apparatus 22, a selection can be made from among a plurality of model vehicles mounted on the rail system 9, for example the model vehicles 3,4, if an individual, different characteristic or address is allocated to each control and evaluation device 15 in the model vehicles 3, 4. The model vehicle addressed via the selector switch 34 can for example be moved forward by rotation of the regulating button 34 from a zero position 40, in which the addressed model vehicle is at a standstill. Depending on the angle of rotation selected on the regulating button 35, proceeding from the zero position 40 the electric motor 11 in the respectively addressed model vehicle is supplied with a correspondingly higher or lower voltage from the control and evaluation device 15, so that a corresponding setting for travelling speed for the model vehicle is effected. Instead of the voltage increase or decrease for the electric motor 11 mentioned, it is likewise possible to regulate the performance, for example in the form of a pulse-width modulation, or an increase or decrease in the current intensity for speed regulation of the electric motor 11, and thus to set the travelling speed for the model vehicles.

By means of rotating the regulating button 35, proceeding from the zero position 40, in the opposite direction, the polarity of the supply voltage to the electric motor 11 is changed, and the addressed model vehicle is thus for example moved in reverse. The angle of rotation of the regulating button 35 in turn determines the speed of the reverse movement.

Thus, depending on the angular alteration of the regulating button 35 per unit of time for each of the two rotational directions, proceeding from the zero position 40, the respective acceleration or deceleration procedure can be determined for both reverse and forward movement of the selected model vehicle, or if necessary of the addressed model vehicles. Depending on the speed of rotation of the regulating button 35, therefore correspondingly high or low acceleration or deceleration values of the model vehicle may be selected.

The top or maximum speed of the model vehicles 3, 4 is determined by end stops 41, 42 which limit further rotation of the regulating button 35 in both directions, proceeding from the zero position 40.

By means of the operating and/or display apparatus 22 shown in broken lines, a further user of the model railway system 1 can intervene in the control sequence of the model vehicles 3, 4 or also of a plurality of model vehicles. By means of the operating elements of the operating and/or display apparatus 22, transfer or take-over of the control functions or of the control rights of a model vehicle is possible between users of the model railway system 1. The number of operating and/or display apparatus 22 and thus the number of users who may participate simultaneously in control of the model railway system 1 is therefore almost unrestricted.

Figure 2:
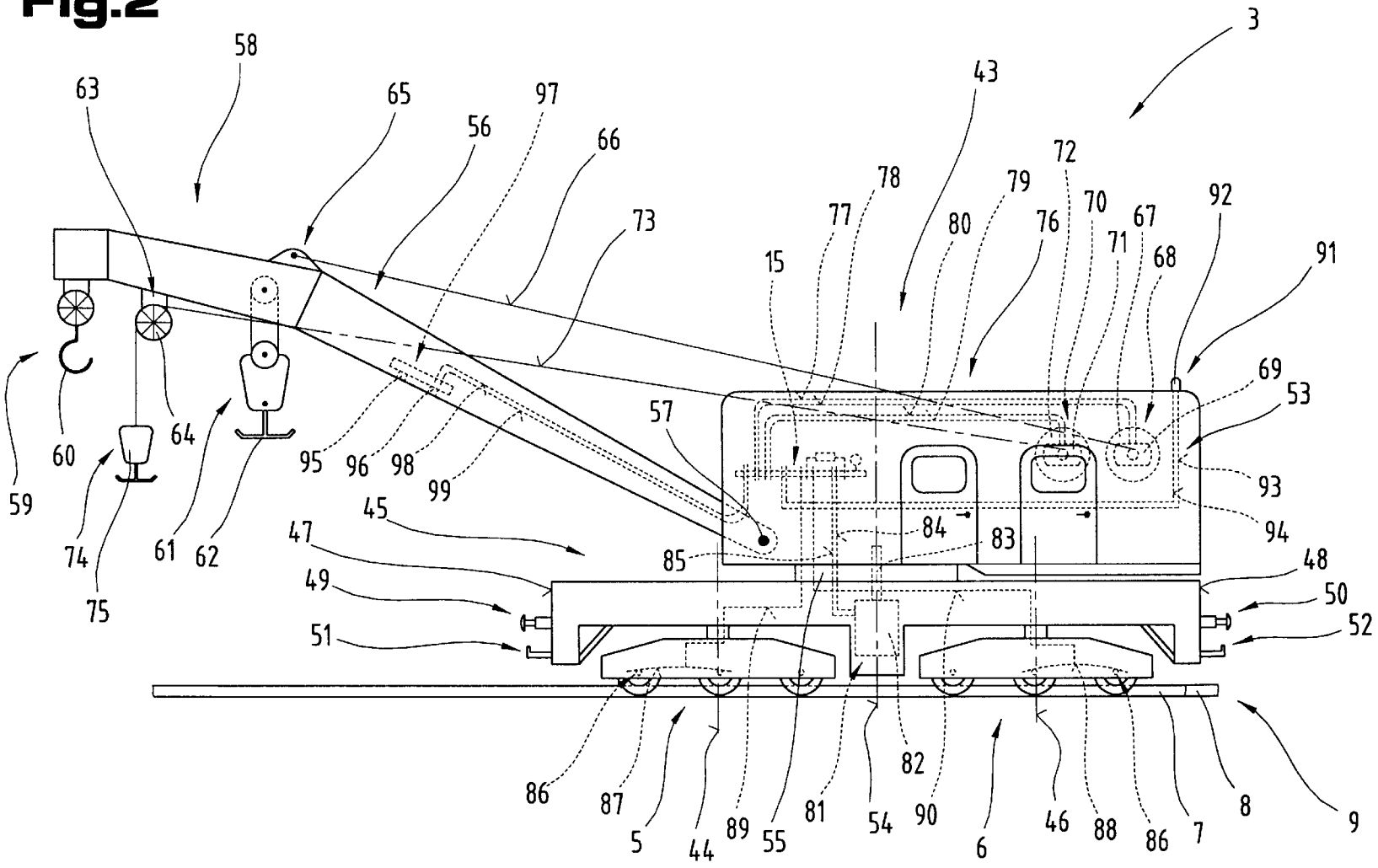
FIG. 2 a constructional variant of a model railway crane according to the invention.

The model vehicle 3, particularly a model railway crane 43, shown schematically in plan view in FIG. 1, is shown in side elevation in FIG. 2. This model railway crane 43 is mounted on the rail system 9 via the wheel and axle arrangements 5, 6. The wheel and axle arrangements 5, 6, in accordance with reality, respectively comprise three running gear axles with two wheels each. The wheel and axle arrangement 5 is mounted to rotate about an axis 44 extending normally to the contact plane of the model railway crane 43, on a running gear frame 45 of the model railway crane 43. The further wheel and axle arrangement 6 is likewise mounted to rotate about an axle 46 spaced remote from the axle 44 and extending perpendicularly to the contact plane. Due to the rotarily movable mounting of the wheel and axle arrangements 5, 6, the assembly can run easily through small-radius curves in the rail network 9 with exact lateral guidance of the model railway crane 43 on the rails 7, 8, as the wheel and axle arrangements 5, 6 undertake a corresponding compensation due to their rotarily movable mounting.

Pairs of buffers 49, 50 are placed, true to reality, on the ends 47, 48 of the running gear frame 45. Accordingly, a coupling device 51 or 52 is placed between each pair of buffers 49 and 50. In this way a model wagon, a model locomotive or, in accordance with the true pattern, a crane runner wagon can be coupled, upon which the crane arm can be supported after use, and, for transfer of the model railway crane 43 into its duty position, no parts projecting over the buffers 49, 50, particularly formed by the crane arm, are present, and therefore there is protection from mechanical damage to model vehicles of the model railway system 1.

A superstructure 53 is mounted on the running frame 45, and is mounted to rotate about a pivotal axis 54 extending in the central region of the running frame 45, and perpendicularly to the plane of contact, between the superstructure 53 and the running frame 45.

On one end region of the superstructure 53 a crane jib 56 is mounted to rotate about an axis 57 extending parallel to the plane of contact.

In an end region 58 of the crane jib 56 opposite the axis 57, there is located at least one weight-lifting means 59, especially a hook 60. A further weight-lifting means 61, especially a hook 62, is located at a spacing from the weight-lifting means 59 in the direction of the axis 57 of the crane jib 56.

A deflecting device 63, particularly a cable roller 64, may preferably be provided between the weight-lifting means 61 and the weight-lifting means 59. Further provided on the crane jib 56, preferably in the end region 58, is an attachment device 65, connected to one end of the jib cable 66. The further end of the jib cable 66 is connected to a cable drum 67, or a portion of the jib cable 66 is wound on to this cable drum 67. The cable drum is connected in the direction of rotation with a drive device 68, particularly an electric motor 69, preferably with an interposed transmission or torque converter.

The crane jib 56, in accordance with the model of the model railway crane 43, is preferably raised or lowered using means not shown in FIG. 2 for increasing the lifting force, particularly a block and tackle, by the drive device 68. For this purpose a portion of the block and tackle is secured to the attachment device 65, the other portion of the block and tackle is located in the superstructure 53, and the jib cable 66 is passed about both portions of the block and tackle, one end of the jib cable 66 being secured in the superstructure, and the other end of the jib cable 66 being secured on the cable drum 67 of the drive device 68. Due to the multiple passage of the jib cable 66 through the block and tackle, comparatively higher lifting forces are achieved for the crane jib 56 with the same drive device 68. When the crane jib 56 is raised, the portion of the block and tackle located in the superstructure 53 pivots above the roof surface of the superstructure 53.

Adjacent to the drive device 68 is a further drive device 70, particularly an electric motor 71, coupled to a cable drum 72. An end portion of the crane cable 73 is wound on to this cable drum 72 and the other end of the crane cable 73 is passed about the deflector device 63. This end of the crane cable is connected to a weight-lifting means 74, especially to a crane hook 75.

The drive devices 68, 70, are preferably inside the superstructure 53, and only the jib cable 66 and the crane cable 73 emerge out of a roof area 76 or the front end area of the superstructure 53 when the crane jib 56 is raised.

The electric motor 69 of the drive device 68 is electrically conductively connected by lines 77, 78 to the control and evaluation device 15, and the electric motor 71 of the drive device 70 is electrically conductively connected by lines 79, 80 likewise to the control and evaluation device 15.

Furthermore, the stator of a drive device 81, particularly of an electric motor 82, is secured to the running frame 45. Thus the medial longitudinal axis of a drive shaft 83 of the electric motor 82 registers with the pivotal axis 54 of the superstructure 53, and the superstructure 53 is secured to the drive shaft 83 of the electric motor 82. Lines 84, 85 lead from the electric motor 82 to the control and evaluation device 15 and thus can supply the electric motor 82 with electrical power.

When the electric motor 82 is supplied with electrical power by the lines 84, 85 from the control and evaluation device 15, the drive shaft 83 and thus the superstructure 53 coupled thereto are set in rotation. The bearing arrangement 55 between the superstructure 53 and the running frame 45 selves to absorb the radial and axial forces which would otherwise act on the pivotal axis 54 or on the drive shaft 83.

It is likewise possible to secure the stator of the electric motor 82 in the superstructure 53 and to couple the drive shaft 83 to the running frame 45 so that, upon a rotary movement of the superstructure 53, the lines 84, 84 cannot become wound around the pivotal axis 54 or drive shaft 83 or other parts of the bearing arrangement 55. Likewise, it is possible instead of the lines 84, 85 described for power supply to the electric motor 82, to locate at least two slideways, lying with their centres on the pivotal axis 54, on the running frame 45, and to associate therewith at least two sliding contacts on the superstructure 53. Thus an unlimited number of rotations of the superstructure 53 in one direction is possible without lines winding about the pivotal axis 54 or drive shaft 83.

Likewise, the sliding contacts may be located on the running frame 45, and the slideways on the superstructure 53.

The speed of the electric motor 82 is preferably stepped down via a subsequent transmission or a subsequent torque converter, and the available torque is thus simultaneously increased.

Naturally, instead of the transmission unit mentioned, it is also possible to attach a relatively small drive pinion to the drive shaft 83, and to design the bearing arrangement 55 as a preferably internally-toothed, relatively large gear wheel, and to bring both gear wheels into engagement with one another. In this way simple manner on the one hand a stable mounting of the superstructure 53 on the running frame 45 is achieved and also a reduction in the speed of the electric motor 81.

Naturally, it is also possible to design the bearing arrangement 55 as an externally-toothed gear wheel, and to have the drive shaft 83 engage in the externally-toothed bearing arrangement 55 with the relatively small pinion, off-centre to the pivotal axis 54.

Preferably, however, the bearing arrangement 55 is designed in the manner of an epicyclic gear, the drive pinion on the drive shaft 83 forming the central or sun wheel. Located around this sun wheel are at least three revolving or planet wheels, thus engaging with the sun wheel. An internally-toothed crown wheel connected Lo the superstructure 53 surrounds the planet wheels in such a way that it is in engagement therewith. When the electric motor 82 is supplied with electrical power, therefore, the superstructure 53 is set in rotation, high torques being capable of transmission by means of the epicyclic gear, and a reduction in speed of the electric motor 82 being simultaneously achieved.

Because the crane jib 56 projects beyond the running frame 45, it swings out when travelling through bends in relation to the rail system 9. When the model railway crane 43 is being transported to its operational site, in order not to derail the crane runner wagon upon which the crane jib 56 is supported, a free wheel mechanism for the superstructure 53 is located in the region of the bearing arrangement 55. This free wheel mechanism is preferably formed by an axial displacement of the sun wheel on the drive shaft 83. The sun wheel is displaced on the drive shaft 83 far enough for it to disengage from the planet wheels. This axial displacement of the sun wheel may be effected manually by a lever mechanism and/or remotely by an electromagnet. When the free wheel mechanism is actuated, the superstructure 53 is thus uncoupled in the direction of rotation from the drive motor 82, so that when the model railway crane 43 passes through bends, the superstructure 53 enables a corresponding compensation, and thus cannot derail the crane runner wagon when the crane jib 56 is mounted thereon.

Power supply to the model railway crane 43 is effected in a known way via the rails 7, 8 of the rail system 9. The wheels of the wheel and axle arrangements 5, 6 are thus made of electrically conductive material and connected by an electrically conductive shaft to a drive axle 86. In order not to short-circuit the voltage-carrying rails 7, 8 of the rail system 9, the wheels of each drive axle 86 must be electrically insulated from one another. This is preferably brought about in that the wheel hub of one wheel of all drive axles 86 is made of plastic, and the preferably metallic shaft of the drive axle 86 is pressed into this plastic wheel hub.

Mounted with a resilient bias force on at least one shaft of the drive axles 86 of the wheel and axle arrangement 5 there is supported a sliding member 87, thus deriving the electrical potential, e.g. from rail 7. Likewise, a sliding member 88 is supported with resilient bias force on at least one shaft of the drive axles 86 of the wheel and axle arrangement 6, thus deriving the electrical potential from the other rail, accordingly rail 8.

The electrical potential derived by the slide member 87 is passed through a supply line 89, and the electrical potential derived by the slide member 88 is passed through a supply line 90, respectively to the control and evaluation device 15.

The supply lines 89, 90 are passed in a concealed fashion, preferably inside the bearing arrangement 55, from the running frame 45 to the superstructure 53. As already described above, it is also of advantage to design the supply lines 89, 90 in the area of the bearing arrangement 55 as corresponding slideways and slide contacts, so that an unrestricted number of rotations of the superstructure 53 is possible for both directions of rotations, as the supply lines 89, 90 cannot become wound about portions of the bearing arrangement 55.

It is likewise possible to make the shafts of the drive axles from plastics and to derive current on the inner sides of the wheels. A warning lamp 91, especially a light-emitting diode 92, is preferably located in the roof area 76 of the superstructure 53, and connected via lines 93, 94 to the control and evaluation device 15. Depending on the supply of electrical power to the lines 93, 94 from the control and evaluation device 15, a permanently illuminated or flashing pattern can be set on the warning lamp 91. Luminous means 95, particularly miniature incandescent lamps 96, representing operating headlights, are preferably located on the crane jib 56. The luminous means 95 can be supplied with electrical power from the control and evaluation device 15 via lines 98, 99.

When the drive devices 68, 70, 81 are supplied with electrical power from the control and evaluation device 15, depending on the polarity of the lines 77, 78; 79, 80; 84, 85; the respective function of the model railway crane 43 is executed. Depending on the polarity of the electric motor 69 of the drive device 68, the crane jib 56 is raised or lowered, and depending on the polarity of the electric motor 71 of the drive device 70, the crane hook 75 is raised or lowered by means of the crane cable 73. Similarly, depending on the polarity of the electric motor 82 of the drive device 81, the superstructure 53 can be set into left-hand or tight-hand rotation with respect to the running frame 45. Depending on the form of voltage at the warning lamp 91 or at the luminous means 95, i.e. whether a constant or pulsating voltage is involved, these latter may be operated with permanent light or with a flashing light.

Figure 3:
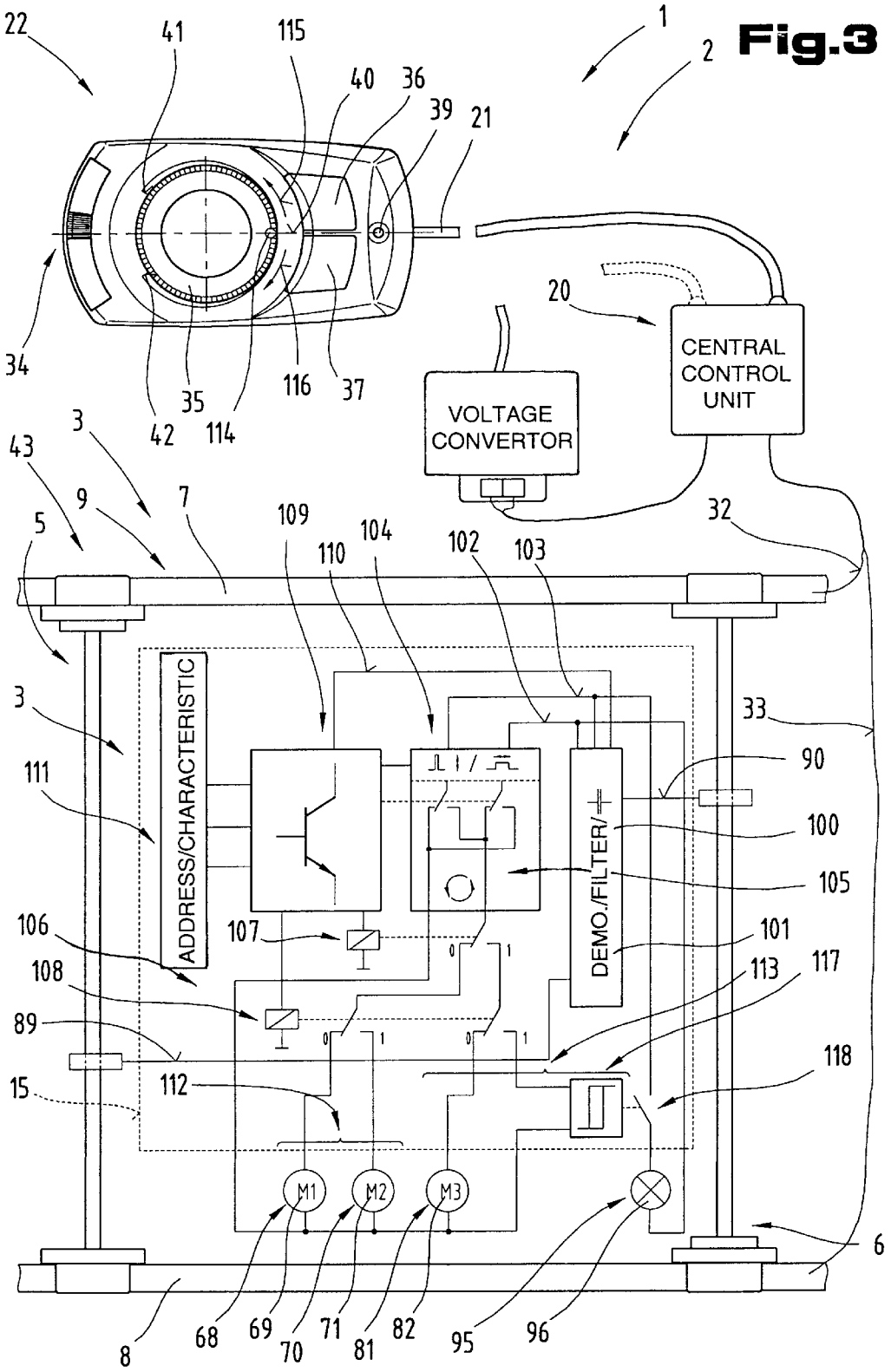
FIG. 3 a simplified, schematic view of the control system according to the invention of the model railway system with the control and evaluation device for the model vehicle.

FIG. 3 shows the control system 2 of the model railway 1 and a block diagram of the control and evaluation device 15 for model vehicles, particularly for the model railway crane 43 according to FIG. 2. The use of this control and evaluation device 15 however is not restricted to the model railway crane 43 shown in FIG. 2. It is naturally possible to use the schematically shown control system 2 for any optional model vehicle, which is required to have a plurality of remotely-controlled functions.

All the functions of the model vehicle 3, for example the model railway crane 43, are remotely controlled by the operating and/or display apparatus 22 described in FIG. 1. The same reference numbers are used for identical parts of the control system 2 and of the model railway crane 43.

In order that a user of the model railway system 1 can control any model vehicle 3 mounted on the rail system 9, he must set a preferably clearly allocated address corresponding to the model vehicle, via the selector switch 34 on the operating and/or display apparatus 22. The respectively set address is transmitted by the operating and/or display apparatus 22 through the connector cable 21 to the central control unit 20. The central control unit 20 administers all incoming control commands, for example from a plurality of operating and/or display apparatus 22, and passes these control commands or the respectively set address in a suitable form via the lines 32, 33 to the rail system 9. For example, the control data and/or addresses may be superimposed on the supply voltage for the model vehicles permanently present on the rails 7, 8. Superimposition of the control signals and of the supply voltage is effected in the central control unit 20.

Thus the control instructions and/or addresses can be superimposed on the supply voltage for the model vehicles permanently present in the normal operational condition on rails 7, 8, in a frequency-modulated, amplitude-modulated, pulse-width- or pulse-interval-modulated form.

The voltage potentials applied to the rails 7, 8, as already described above, can be passed to the control and evaluation devices 15 in each model vehicle mounted on the rail system 9 and having functions to be remotely controlled, or to a demodulator 100 or to a filter circuit 101. The demodulator 100 or filter circuit 101 separate the voltage potentials derived from the wheel and axle arrangements 5, 6 into power voltage and control or address information. The power voltage is then passed via lines 102, 103 to a regulating device 104 for alteration of the drive power given off to the drive devices 68, 70, 81. The regulating device 104 can for example be formed by a controllable voltage-reduction or voltage-increase device or a pulse-width, or pulse-interval modulator device for altering the available supply voltage and thus for altering the speed of the drive devices 68, 70, 81. If the speed of the drive devices 68, 70, 81 is dependent on the frequency of the feed voltage, the regulating device 104 is formed by a frequency converter circuit.

On the output side, the regulating device 104 is connected to a schematically shown switch-over device 105 for reversing the rotational direction of the drive devices 68, 70, 81. The switch-over device 105 is connected at the output side with a switching network 106, shown by way of example, which is preferably formed by bistable relays 107, 108. The individual outputs of the switching network 106 are electrically conductively connected respectively to a connector of the drive devices 68, 70, 81, and indirectly electrically coupled with another electrical consumer, particularly the luminous means 95. The further connectors of the drive devices 68, 70, 81 are passed in common to the second output connector of the switch-over device 105.

Naturally it is also possible to precede the regulating device 104 by the switch-over device 105, or to provide for at least drive device 68, 70, 81 an individual regulating device 104 and/or an individual switch-over device 105.

The control and evaluation device 15 further has a control device 109 to which the control instructions or addresses are passed from the demodulator 100 or from the filter circuit 101 through a line 110. The control device 109 is further connected to a memory device 111 which is preferably formed by a non-volatile memory, particularly a EEPROM memory or by miniature DIP-switches.

On the output side, the control device 109 is connected to the regulating device 104, the switch-over device 105 and the switching network 106.

The address of the model vehicle is deposited or secured in a memory device 111. Each address or characteristic of the model vehicle is preferably present only once, so that each model vehicle can be addressed in a controlled manner and independently of the other model vehicles.

The addresses received from the control device 109 via the line 110 are permanently compared with the address deposited in the memory device 111. When the deposited and transmitted addresses coincide, the control commands issued via the operating and/or display apparatus 22, which are likewise transmitted over line 110 of the control device 109, are evaluated and executed.

Four clearly differentiated conditions can be produced with the two function keys 36, 37 on the basis of the binary system. This is calculated room the base two of the binary system to the power two of the function keys 36, 37 and thus gives four clearly differentiated conditions.

Thus by means of function key 36 for example switching can be carried out between two function pairs 112, 113, by key pressure respectively on the other function pair 112 or 113, i.e. from function pair 112 to function pair 113 or vice versa. Switch-over can be carried out by the function key 37 then within each function pair 112 or 113 by key pressure, between two further functions. The function pair 112 for example is formed by the drive devices 68, 70 and function pair 113 by the drive device 81 and the luminous means 95.

If the user of the model railway system 1 for example presses the function key 36 on any optional operating and/or display apparatus 22, the corresponding instruction-is passed to the central control unit 20 and further to the rail system 9. The model vehicle thus addressed via the selector switch 34 recognises this control command and the control device 109 of this model vehicle passes a voltage pulse to the preferably bistable relay 107. This relay 107 switches over and, after the descending flank of this pulse, remains in the operational condition last switched. This is for example the switch condition shown in FIG. 3 with the characterisation "0". If the user further presses the function key 37, this instruction is registered by the respectively addressed control device 109 and therefrom a short voltage pulse is emitted to the preferably bistable 2× UM-relay 108. The relay 108 therefore switches over and after removal of the control voltage remains in this switched condition. This for example as shown in FIG. 3 is the switch condition with characteristic "0".

The user of the model railway system 1 has thus selected the drive device 68 and can control the corresponding electric motor 69. This is effected by rotation of the regulating button 35, proceeding from zero position, in which a marking 114 on the regulating button 35 is in registry with the zero position 40. If the regulating button 35 is for example rotated in the direction of an arrow 115, this control instruction is passed to the central control unit 20 and further is evaluated by the addressed model vehicle and accordingly the electric motor 69 is supplied with electrical power.

The height of the voltage passed to the electric motor 69 depends on the angle of rotation of the regulating button 35. The angle of rotation of the regulating button 35 is transmitted to the control device 109, and passed in a corresponding form to the regulating device 104. The regulating device 104, on the basis of this set speed, or the set angle of rotation of the regulating button 35, alters the voltage amplitude or the pulse-widths or pulse intervals, so that the electric motor 69 is operated with the respective speed.

The direction of rotation of the regulating button 35 in accordance with arrow 115 is likewise transmitted to the control device 109, so that for example the switching network 106 is supplied on the input side with positive potential, and the electric motor 69 therefore has a specific direction of rotation. Upon rotation of the regulating button 35 in accordance with arrow 115, for example, the electric motor 69 is set in motion in the direction of rotation in order to lower the crane jib 56. Upon rotation of the regulating button 35, proceeding from zero position 40, in accordance with an arrow 116, the electric motor 69 last selected by the function keys 36, 37 is set in motion in the opposite rotational direction, so that the crane jib 56 is raised. The direction of rotation of the regulating button 35 is thus evaluated by the switch-over device 105 as instructions regarding direction of rotation for the electric motor 69.

If the user in turn for example actuates the function key 37, the control device 109 evaluates this instruction and passes a voltage pulse to the relay 108, so that the latter switches over into the switch condition marked by "1", and after removal of the voltage, remains in this condition. Thus the respective drive power is passed to the drive device 70 or to the electric motor 71. The direction of rotation and speed of the electric motor 71 is in turn determined as already described before, by the direction of rotation of the regulating button 35 in accordance with arrows 115 or 116, and by the angle of rotation of the regulating button 35 in one of the two rotary directions, proceeding from the zero position 40. The maximum speed of the electric motors 69, 71, 82 is achieved by rotating the regulating button 35 to the respective end stops 41, 42. Thus the regulating device 104 emits the maximum voltage amplitude, or in the case of pulse-width modulation, no further pulse intervals are present.

At this setting of the switching network 106, for example, the crane hook 75 is moved upwards or downwards with adjustable speed by means of the electric motor 71 via the regulating button 35.

If the user presses function key 37 once more, the system switches again to the drive 68, i.e. to the crane jib 56.

If however the user presses the function key 36, the relay 107 is briefly triggered by the regulating device 109 and switches over to the switch condition marked by "1". If the relay 108 is in the switch condition marked by "0", the drive device 81 can now be provided with drive power. The speed and direction of rotation of the electric motor 82 of the drive device 81 thus in turn depends on the setting of the regulating button 35, i.e. from the direction of rotation and angle of rotation of the regulating button 35. Accordingly the superstructure 53 of the model railway crane 43 can be rotated with respect to the running frame 45 via the drive device 81. Upon rotation of the regulating button 35 in accordance with arrow 115, the superstructure 53 rotates anti-clockwise, and upon rotation of the regulating button 35 in accordance with arrow 116, the superstructure 53 rotates clockwise.

If subsequently the function key 37 at the operating and/or display apparatus 22 is actuated, the relay 108 switches over into the switch condition which is marked with "1" and the luminous means 95 are selected for triggering. Preceding the luminous means 95, particularly the miniature incandescent lamps 96 or also the light-emitting diode 92, is a limiting circuit 117, which obtains threshold values or the control signals of the regulating button 35, i.e. the direction and angle of rotation of the regulating button 35, via the switching network 106.

If the luminous means 95 is selected as an electrical consumer via the switch network 106, the corresponding control signals of the regulating button 35 are applied to an input of the limiting circuit 117. This limiting circuit 117 is in particular activated by a Schmitt trigger, which, when a specific angular position of the regulating button 35 is exceeded, sets an output or actuates a switch member 118 constructed as a closer contact, and thus supplies the luminous means 95 with electrical voltage, preferably at the constant supply voltage of the lines 102, 103. The current flow through the switch member 118 is interrupted by the limiting circuit 117 only after a specific threshold value has been undershot; this may be achieved for example by rotating the regulating button 35 in the opposite direction and by exceeding a specific angle of rotation.

Thus the limiting circuit 117 tilts into the second switching condition only when a second threshold value has been exceeded or undershot. Removal of the voltage at the input of the limiting circuit 117, for example by switching of the switching network 106, causes no alteration at the output of the limiting circuit 117, so that the luminous means 95 remains in the respectively selected condition, i.e. in the switched-on condition or in the switched-off condition, even if the drive device 68, 70 or 81 has also been selected. By exceeding a specific angle of rotation of the regulating button 35, therefore, the luminous means 95 can be switched on, and accordingly switched off when a specific angle of rotation for the respectively other direction of rotation selected is undershot.

In order to produce a flashing light for the luminous means 95, it is further possible in a simple way to control the switch member 118 of the control device 109 periodically, roughly in the hertz range, through an individual line. Likewise it is possible in order to produce the flashing light for luminous means 95 or the light-emitting diode 92, to locate an individual switch member not shown in the supply current circuit of the luminous means 95, or of the light-emitting diode 92, and to apply the control input or the base of this switch member to the control device 109.

It is likewise possible to use luminous means 95, in particular light-emitting diodes 92, with a flashing light function. In order to switch these luminous means 95 on and off, the switch member 118 is for example located in a supply line, said member, controlled by the control device 109, being capable of interrupting or closing the supply circuit.

It is also possible to use, instead of the luminous means 95, a further drive device by means of which for example travelling gear for the model vehicle 3 or the model railway crane 43 is realised.

Preferably there is located centrally to the regulating button 35 a stop key which when activated takes both supply voltage and control instructions from the rail network 9 and thus causes stoppage of all model vehicles or all controllable functions of said model vehicles. This stop key may for example be used in order to avoid collisions between model vehicles on the model railway system 1.

A plurality of functions may be controlled in a well-arranged and simple manner with each operating and/or display apparatus 22 connected to the central control unit 20. By means of the selector switch 34, a model vehicle may be selected from a plurality of model vehicles and then controlled. By means of the function keys 36, 37 a selection can be made from among four functions of the addressed or selected model vehicle. The direction of rotation and simultaneously the speed may be regulated in a simple way by the regulating button 35. At the same time acceleration and deceleration values of the model vehicle can be altered, by varying the angle of rotation of the regulating button 35 per unit of time. Upon rapid rotation of the regulating button 35 in accordance with arrows 115 or 116, therefore, a high acceleration value of the respectively selected drive device 68, 70, 81 and, upon rapid rotation of the regulating button 35 contrary to the arrows 115, 116, a high deceleration value may be reached for the selected function, for example a travelling gear. Accordingly, with a relatively low speed of rotation of the regulating button 35, a correspondingly low acceleration or deceleration of the respective drive device 68, 70, 81 can be achieved.

Figure 4:
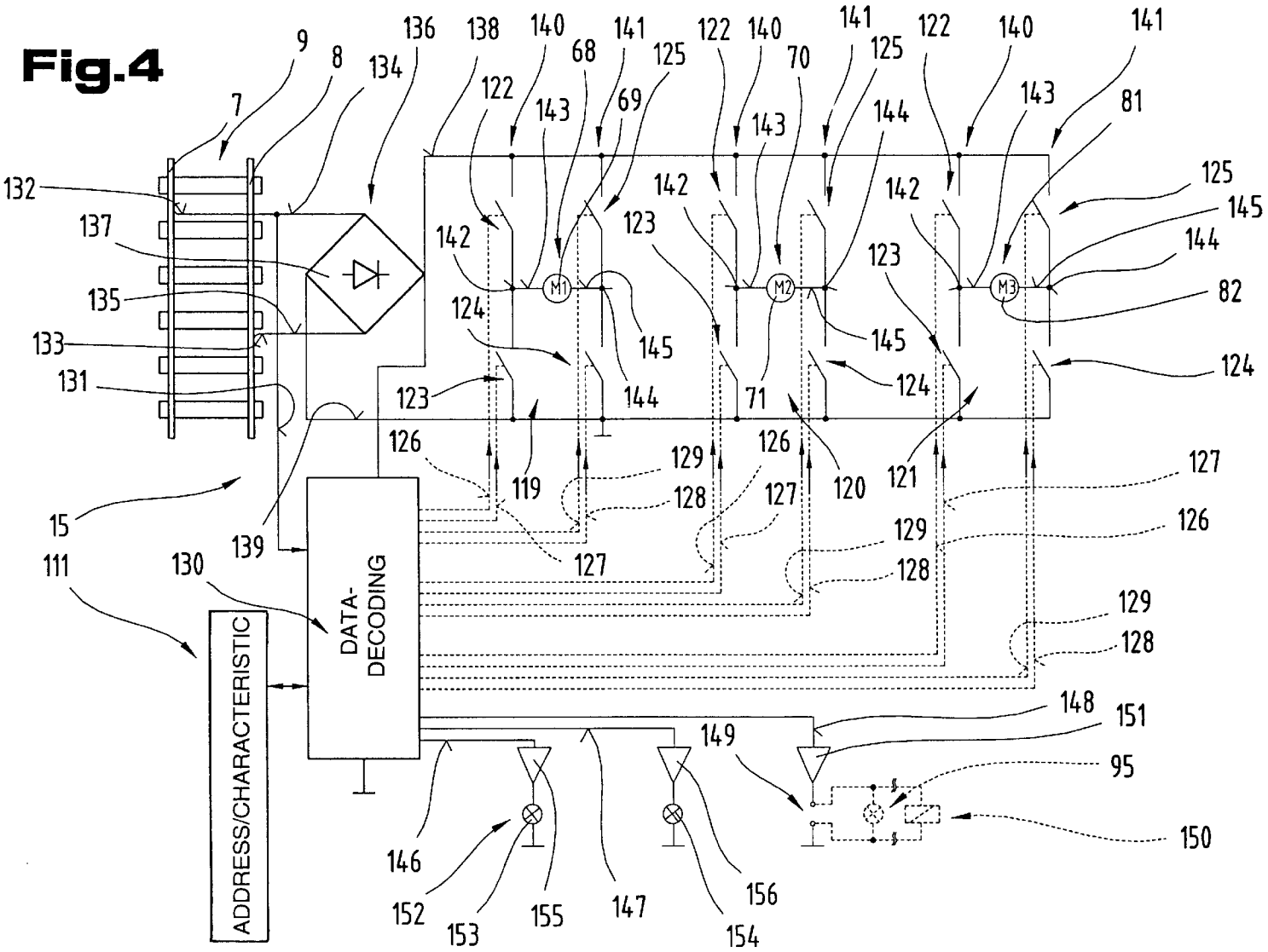
FIG. 4 a block diagram of another valiant construction of the control and evaluation device for the model vehicles, in a simplified, schematic view.

FIG. 4 shows a block diagram of a further variant of the control and evaluation device 15 for model vehicles; the same reference numbers are used for parts already shown in the preceding Figures.

Change of direction, and speed setting, of the drive devices 68, 70, 81, particularly of their electric motors 69, 71, 82, is effected via bridge circuits 119, 120, 121, particularly of the full bridge constructive type. Switch elements 122 to 125 of each bridge circuit 119 to 121 may be triggered via control lines 126 to 129 of a decoding unit 130.

This decoding unit 130 is electrically conductively connected by a data line 131 to the voltage potentials, for example of the rail 7 of the rail system 9. In addition, the voltage potentials present on the rail system 9 are supplied at the input side, for example by pick-up members 132, 133 sliding on the rails 7, 8 and via lines 134, 135 to a rectifier 136, formed in particular by a bridge rectifier 137. The rectifier 136 changes the electrical power supplied via the lines 134, 135 into direct current and for example passes the positive potential of the direct current through a supply line 138, and the negative potential of the direct current through a supply line 139, to the bridge circuits 119 to 121.

Each of the bridge circuits 119 to 121 comprises two series circuits 140, 141; the series circuit 140 is formed by incorporation in series of the switch members 122, 123, and series circuit 141 by incorporation in series of the switch members 124, 125.

A centre point 142 of the bridge between the switch members 122, 123 of the series circuit 140 is electrically conductively connected via a line 143 respectively with a connector of the electric motors 69, 71, 82 of the bridge circuits 119, 120, 121. A further bridge centre point 144 between the switch members 124, 125 of the series circuit 141 and incorporated in series, is electrically conductively connected via a line 145 with the respective further connector of the electric motors 69, 71, 82 of bridge circuits 119, 120, 121.

Each of the series circuits 140, 141 is respectively electrically conductively connected to an end connector by the supply line 138, and the remaining end connectors of the series circuits 140, 141 are electrically conductively connected to the supply line 139.

The voltage potentials applied to the rail system 9 by the central control unit 20 (not shown) and/or the operating and/or display apparatus (not shown), particularly the supply voltage and the control signals, are passed via the data line 131 of the decoding unit 130 of the control and evaluation device 15 in each model vehicle. Each decoding unit 130 evaluates the received control signals and, when the address received via the control signals and the address stored in the memory device 111 coincide, emits corresponding control commands, in particular voltage pulses, via the control lines 126 to 129 of each bridge circuit 119 to 121, and via control lines 146 to 148.

If the decoding unit 130 of the model vehicle addressed recognises from the control signal received that, for example, the drive device 68 has been selected for actuation, the switch members 122 to 125 of the bridge circuit 119 are correspondingly actuated. Depending on the instruction as to direction of rotation of the control signal, the switch members 123 and 125 or the switch members. 122 and 124 of the bridge circuit 119 are actuated. When the switch members 123, 125 are actuated or when switch members 123, 125 are conductive, the line 143 is electrically conductively connected to the supply line 139 and is thus at negative potential. The line 145 is electrically conductively connected to the supply line 138 and thus is at positive potential. In this way the electric motor 69 is supplied with power and its drive take-off shaft is accordingly for example set into left-hand rotation.

If a switch member 123 or 125, or both switch members 123, 125 are set in the blocked condition, the power supply to the electric motor 69 is interrupted and the rotary movement is stopped. If on the other hand the switch members 123 and 125 or only one switch member 123 or 125 are successively set to the blocked and conductive condition by the decoding unit 130, then the power passed to the electric motor 69 is reduced. This pulse-interval or pulse-width modulation of the power passed to the electric motor 69 effects the speed of the electric motor 69 when the change from the conductive condition into the blocked condition of switch members 123, 125 and vice versa lies roughly in the hertz range.

If the decoding unit 130, on the basis of the rotary direction information of the control signals on the data line 131, recognises a commanded right-handed rotation of the selected electric motor 69, the switch members 122, 124 are set into the conductive condition. In this way the line 143 is electrically conductively connected with the supply line 138, and the line 145 with the supply line 139. The line 143 at positive potential and line 145 at negative potential accordingly cause a right-hand rotation of the drive take-off shaft of the electric motor 69. An alteration in speed of the electric motor 69 for right-hand rotation may in turn be effected by periodic switching on and off of both switch members 122, 124 or of only one of the switch members 122 or 124.

Means for avoiding short-circuits between the supply lines 138, 139, for example due to the conductive condition of the switch members 122 and 123 or the conductive condition of the switch members 124, 125, are effectively integrated in the decoding unit 130, or such switch conditions are excluded by the decoding unit 130.

The switching procedure described above may be used in the same way for setting the direction of rotation and setting the speed of the drive devices 70, 81 of the bridge circuits 120, 121, when the control signals on the data line 131 show actuation of the drive device 70 or of drive device 81.

If the decoding unit 130 recognises a commanded actuation of an additional output 149, as described above, for example of the luminous means 95 shown in broken lines, or of an electromagnet 150 shown in broken lines, high or low level is applied by the decoding unit 130 to the control line 148, and preferably amplified by a driver stage 151 incorporated between control line 148 and the additional output 149.

An optical display means 152, formed in particular by light-emitting diodes 153, 154 is preferably connected to the control lines 146, 147 of the decoding unit 130. In particular, the light-emitting diode 153, preferably with a preceding driver stage 155, is electrically conductively connected to the control line 146, and the light-emitting diode 154, preferably with a preceding driver stage 156, is electrically conductively connected to the control line 147.

The display means 152, in particular the light-emitting diodes 153, 154 serve to provide an optical display of the conditions set via the function keys 36, 37 (not shown in FIG. 4). By pressing the function key 36, for example, the control line 146 is set to high level, so that the light-emitting diode 153 begins to glow. Another pressure on function key 36 sets the control line 146 to low level, and the light-emitting diode 153 is extinguished. This toggle operation of the light-emitting diode 153, caused by the function key 36 applies in the same way to function key 37 and light-emitting diode 154. Therefore, with the display means 152 described above, optical display is possible of the drive device 68, 70, 81 or of the additional output 149, selected by the function keys 36, 37. Control errors can to a great extent be eliminated by the optical display of the selected function.

It is also possible to use an analog display device instead of the binary display means 152 described, particularly when there are more than four functions to be controlled. Thus, for example, when there are eight functions to be controlled, the digital conditions of the three necessary control lines are passed to a digital/analog converter, and following this on the output side is a voltage-dependent display instrument, particularly a voltmeter with a correspondingly-divided scale. Likewise, when there are a plurality of functions to be controlled, it is possible to pass the control lines with the binary coded data in a binary code to a decimal converter and to follow this with corresponding display elements. A binary code to seven segment display driver can also be used. All the display means described above are preferably located on the model vehicles fitted with a plurality of remotely controllable functions. The display means described above can also be associated with the control centre 20 (not shown) and/or with the operating and/or display apparatus 22 (not shown).

It is also advantageous, particularly when there are more than four functions to be remotely controlled, to use a multiple slide switch or a multiple rotary switch with a corresponding scale to select the function to be controlled, or to associate therewith a corresponding switch stage legend, so that separate electrical display means can be omitted.

The bridge circuits 119, 120, 121 of the full bridge constructive type shown schematically in FIG. 4 can naturally also be replaced by bridge circuits 119, 120, 121 of the half-bridge constructive type, the switch members 123, 124 of each bridge circuit 119, 120, 121 being replaced by preferably ohmic resistors and the switch members 122, 125 of each bridge circuit 119, 120, 121 being used for setting the direction of rotation and speed of the electric motors 69, 71, 82.

The switch members 122 to 125 of each bridge circuit 119, 120, 121 can be constructed both as closers and as openers, and can be formed by semiconductor components, particularly transistors, FETs, etc., or by mechanical switches. Integrated bridge circuits of a corresponding switching performance can also be used with the drive devices 68, 70, 81.

The regulating device 104 described in FIG. 3 for setting the speed of the electric motors 69, 71, 82 and the switch-over device 105 for reversing the direction of rotation of the electric motors 69, 71, 82 is replaced in FIG. 4 by an arrangement of bridge circuits 119, 120, 121 for the electric motors 69, 71, 82. It is naturally possible to use any devices known from prior art for reversal of direction of rotation and speed setting of electric motors, particularly for the most varied types of electric motors.

It is naturally also possible, instead of the additional output 149, to arrange a further drive device, for example for a travelling gear of the model railway crane 43, in order to be able to move the model railway crane 43 in a remotely-controlled manner via its individual travelling gear on the rail system 9.

The electromagnet 150, preferably connectable via a clamp and/or plug-in connection to the additional output 149, can for example, as described above, be used for activating or deactivating the free wheel mechanism for the superstructure 53.

Figure 6:
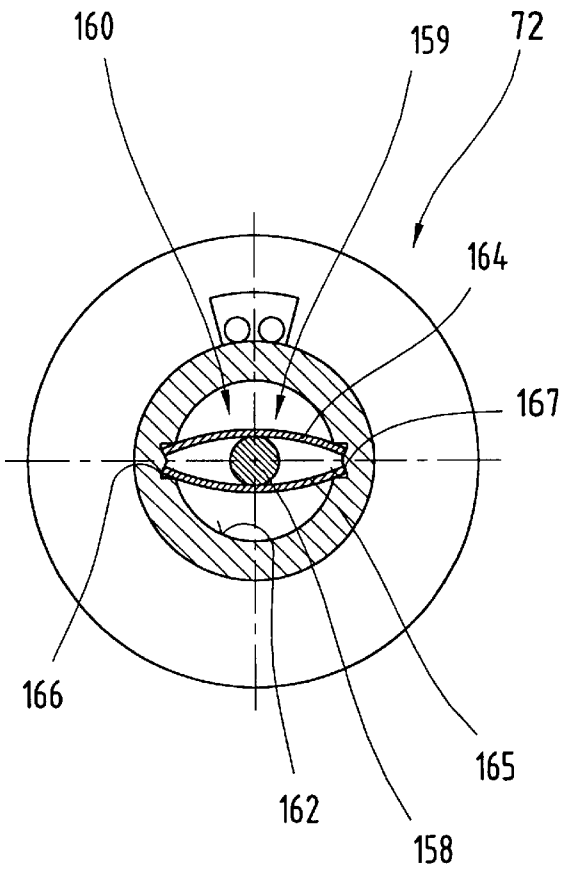
FIG. 6 the overload clutch of the drive device, in section along lines VI–IV in FIG. 5.
Figure 5:
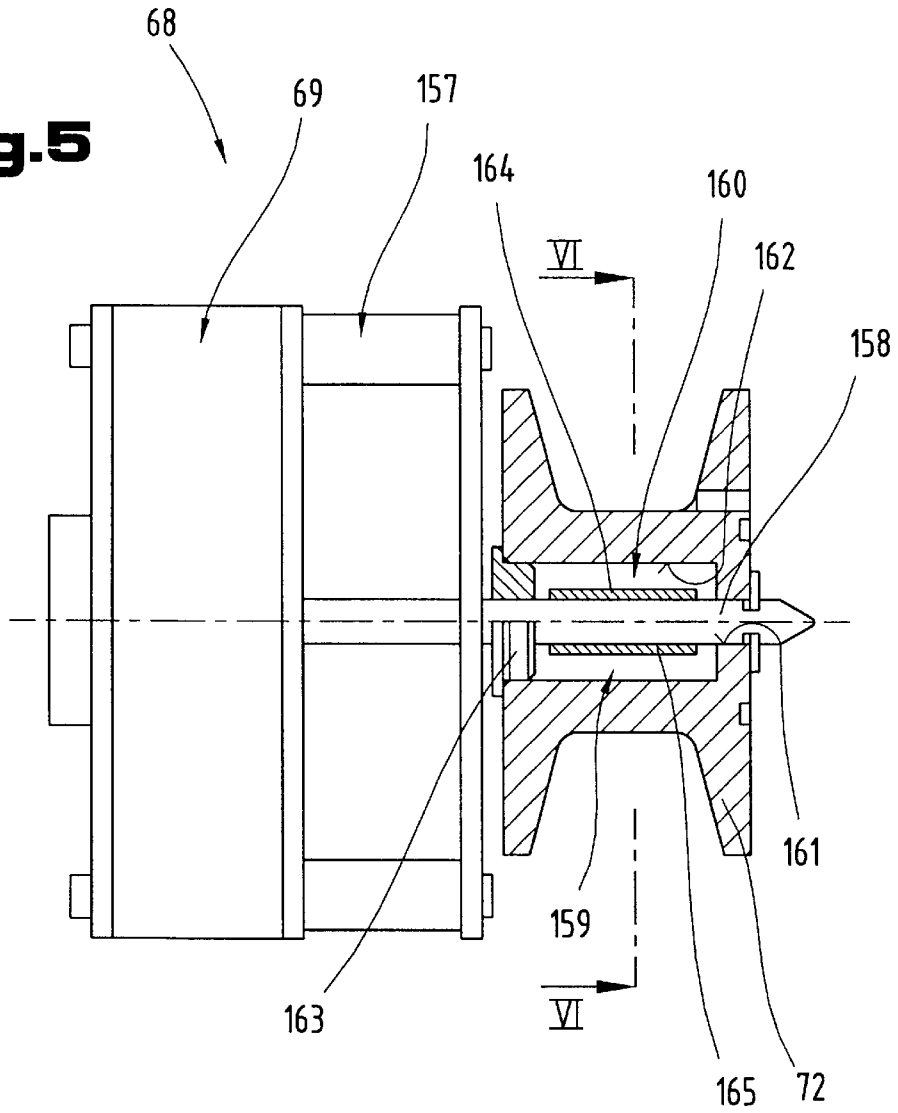
FIG. 5 a simplified schematic view, in partial cross-section, or a drive device for the model vehicle with an overload clutch.

FIGS. 5 and 6 show the drive device 68 of the model vehicle 3, the same reference numbers being used for parts already described above.

For reasons of increased clarity in FIGS. 5 and 6, only the drive device 68 will be discussed in the following. The following description however is equally valid for the drive device 70, and it is naturally possible to use the overload device described in the following in a correspondingly adapted manner also for the drive device 81.

The electric motor 69 of the drive device 68 is coupled in the direction of rotation at the output side with a transmission unit 157. A drive take-off shaft 158 of the transmission unit 157 is connected in the direction of rotation via an overload clutch 159, in particular a slip clutch 160, to the cable drum 72.

The support bore 161 extending centrally to the cable drum 2 has a diameter which is slightly greater than that of the drive take-off shaft 158.

Also arranged centrally to the cable drum 72 is an aperture 162, which in the manner of a blind hole extends over only a portion of the length of the axis of rotation of the cable drum 72. Associated with this aperture 162 is a support member 163 which provides a bearing or supports the cable drum 72 at the beginning of the aperture 162 on the drive take-off shaft 158.

Located in the free space formed between the support member 163 and the support bore 161 are spring members 164, 165. These spring members 164, 165 are supported at their ends in opposed notches 166, 167 in the aperture 162, and the central areas of these plate-like spring members 164, 165 are tensioned radially to the cable drum 72 around the drive take-off shaft 158.

This results in an arcuate configuration of the spring members 164, 165, and the return force of the biased spring members 164, 165 produces a frictional connection between the drive take-off shaft 158 and the cable drum 72.

Depending on the bias force of the spring members 164, 165 on the drive take-off shaft 158, or depending on the coefficient of friction between the spring members 164, 165 and the drive shaft 158, the maximum transmittable torque between the drive take-off shaft 158 and the cable drum 72 can be altered.

If this switching torque of the slip clutch 160 is exceeded, the power flow between the cable drum 72 and the drive take-off shaft 158 is interrupted, so that the drive device 68 itself or components of the model vehicle 3 driven thereby are effectively protected from mechanical overload and ensuing mechanical damage.

As already mentioned above, it is also possible to integrate the overload clutch 159 in the drive pinion of the drive device 81 for rotary drive of the superstructure 53 of the model railway train 43.

Naturally, departing from the embodiment shown of the overload clutch 159, it is possible to design the aperture 162 with a rectangular cross-section, two opposed edges of this rectangular aperture 162 then representing the notches 166, 167.

It is naturally likewise possible within the scope of the invention, departing from the embodiments shown for a model railway system 1, to use the control system 2 and the model railway crane 43 with a three-phase system or an alternating current system.

Finally, it should be noted that in the drawings, individual components and groups of components have been shown out of proportion, distorted in terms of scale or greatly simplified, in order to provide better understanding of the invention.

Individual features of the individual embodiments can form, along with other individual features of other embodiments, or respectively on their own, can form the subject-matter of independent inventions.

Above all, the constructions shown individually in FIGS. 1; 2; 3; 4; 5, 6 can form the subject-matter of independent solutions according to the invention. The purposes and solutions according to the invention relative thereto are to be seen in the detailed descriptions of these Figures.

What is claimed is:

1. A model railway vehicle having a plurality of independently controllable movement functions remotely controllable from a control station, comprising:

a running gear frame rotatably supporting wheels adapted to engage rails of a track for rolling transportation of the vehicle along the track;

a superstructure mounted on the running gear frame such that the superstructure is pivotable relative to the running gear frame;

a first electric drive device in driving connection with the superstructure for causing pivotal movement thereof;

a rotatable cable drum located on the superstructure, the cable drum supporting a cable such that the cable can be reeled onto or withdrawn from the cable drum by rotation of the drum in one or another direction;

a second electric drive device in driving connection with the cable drum for causing rotation thereof;

at least one control and evaluation device located in the model vehicle and adapted to receive control signals from the control station;

at least one regulating device connected with the control and evaluation device and adapted to be connected to the control station;

at least one definable address connected with the model vehicle and accessible to the control and evaluation device; and a switching network connected to the control and evaluation device, said switching network serving for selectably connecting one of the drive devices to at least one regulating device;

the control and evaluation device being adapted to operate the switching network so as to selectably connect the drive devices to the regulating device so as to enable remote control of the drive devices from the control station.

2. The model vehicle according to claim 1, further comprising a plurality of electrical consumers located in the vehicle, and characterised in that the regulating device serves to alter at least one of the supply duration and the supply voltage for the electrical consumers and drive devices.

3. The model vehicle according to claim 2, characterised in that the regulating device serves to alter the supply voltage for the electrical consumers and drive devices.

4. The model vehicle according to claim 2, characterised in that the electrical consumers and drive devices are in direct contact with the supply voltage via the switching network.

5. The model vehicle according to claim 2, further comprising an operating system including a central control unit and function keys electrically coupled on the central control unit, the central control unit being electrically coupled with the switching network.

6. The model vehicle according to claim 5, further comprising a regulating button electrically coupled with the central control unit and with the addressed control and evaluation device.

7. The model vehicle according to claim 6, characterised in that the regulating button is operable to emit control signals for selectably controlling at least one of a speed and a direction of rotation of the drive devices.

8. The model vehicle according to claim 7, characterised in that the regulating button is connected to a switch-over device that is connected with the control and evaluation device and is formed for reversal of the direction of rotation, and wherein the regulating device is operable for alteration in speed of the drive devices by bridge circuits with pulsed switch members.

9. The model vehicle according to claim 8, characterised in that each of the bridge circuits is constructed as one of a full bridge and a half bridge.

10. The model vehicle according to claim 8, characterised in that a decoding unit is arranged for connection of one or more of the drive devices (68, 70, 81) to the supply voltage via the bridge circuits (119, 120, 121).

11. The model vehicle according to claim 10, characterised in that a memory device is connected with the decoding unit for storing at least one address readable by the decoding unit.

12. The model vehicle according to claim 11, characterised in that the model vehicle is adapted to travel along a rail system, and the decoding unit is electrically conductively connected to each control and evaluation device by a data line that is adapted to be connected with the rail system (9), and wherein the decoding unit evaluates the received control signals.

13. The model vehicle according to claim 11, characterised in that a rectifier of the control and evaluation device is electrically conductively connected at an input side of the rectifier by lines to the electrical supply network, and is electrically conductively connected at an output side via supply lines to the bridge circuits.

14. The model vehicle according to claim 1, characterised in that the electrical supply network is formed by a rail system (9).

15. The model vehicle according to claim 11, characterised in that the memory device of the control and evaluation device is formed by non-volatile memory and is connected to one of the control device and the decoding unit.

16. The model vehicle according to claim 11, characterised in that the control and evaluation device has an additional output for triggering one of a luminous means and an electromagnet.

17. The model vehicle according to claim 5, characterised in that the control and evaluation device comprises a display means for indicating the drive device selected via the function keys.

18. The model vehicle according to claim 5, characterised in that the function keys for selecting the drive devices are formed by a multiple stage switch.

19. The model vehicle according to claim 5, characterised in that a selector switch is connected with the central control unit and is electrically coupled to the control and evaluation device the selector switch being operable to transmit an address to the control and evaluation device.

20. The model vehicle according to claim 1, wherein the model vehicle further comprises a set of wheels coupled to a first one of the drive devices such that the vehicle is propelled along a support surface when the first drive device is operated by the regulating device, the wheels being mounted on a frame of the vehicle, and a movable structure pivotally mounted on the frame and coupled to a second one of the drive devices such that the movable structure is pivotally moved relative to the frame when the second drive device is operated by the regulating device.

21. A model vehicle according to claim 1, further comprising a crane jib mounted on an axis disposed on the superstructure and in driving connection with a third drive device via an additional cable drum and a jib cable, the third drive device being connectable with the regulating device via the switching network.

22. A model vehicle according to claim 1, characterised in that an electric motor of each of the drive devices is electrically connected via lines with the control and evaluation device.

23. A model vehicle according to claim 1, wherein an electric motor of the first drive device for pivotal movement of the superstructure is secured in the running gear frame.

24. A model vehicle according to claim 1, wherein an electric motor of the first drive device for pivotal movement of the superstructure is secured in the superstructure.

25. A model vehicle according to claim 1, further comprising a torque-limiting overload clutch coupled with each of the drive devices for limiting torque transmitted to or by the drive devices.

26. A model vehicle according to claim 25, wherein the overload clutches comprise slip clutches.

27. A model vehicle according to claim 26, wherein each slip clutch is formed by spring members biased in an arcuate shape on a drive take-off shaft of the respective drive device.

* * * * *